US011769608B2

(12) United States Patent
Hjortstam et al.

(10) Patent No.: US 11,769,608 B2
(45) Date of Patent: Sep. 26, 2023

(54) MFC IN PRESSBOARDS FOR HV DEVICES

(71) Applicant: Hitachi Energy Switzerland AG, Baden (CH)

(72) Inventors: Olof Hjortstam, Västerås (SE); Fredrik Sahlen, Västerås (SE); Elson Montibon, Ludvika (SE); Anders Eriksson, Ludvika (SE); Erik Keil, Fårbo (SE)

(73) Assignee: HITACHI ENERGY SWITZERLAND AG, Baden (CH)

( * ) Notice: Subject to any disclaimer, the term of this patent is extended or adjusted under 35 U.S.C. 154(b) by 0 days.

(21) Appl. No.: 17/912,107

(22) PCT Filed: Mar. 17, 2021

(86) PCT No.: PCT/EP2021/056830

§ 371 (c)(1),
(2) Date: Sep. 16, 2022

(87) PCT Pub. No.: WO2021/185913

PCT Pub. Date: Sep. 23, 2021

(65) Prior Publication Data

US 2023/0121933 A1 Apr. 20, 2023

(30) Foreign Application Priority Data

Mar. 17, 2020 (EP) ..... 20163744

(51) Int. Cl.

| | |
|---|---|
| ***H01B 3/52*** | (2006.01) |
| ***H01B 3/20*** | (2006.01) |
| ***H01F 27/32*** | (2006.01) |

(52) U.S. Cl.
CPC ..... *H01B 3/52* (2013.01); *H01B 3/20* (2013.01); *H01F 27/321* (2013.01)

(58) Field of Classification Search
None
See application file for complete search history.

(56) References Cited

U.S. PATENT DOCUMENTS 4,019,996 A * 4/1977 Jay ..... H01F 27/105 252/77
4,752,355 A * 6/1988 Provost ..... D21H 5/1272 162/146

(Continued)

FOREIGN PATENT DOCUMENTS

AU 2015273825 B2 * 3/2017 ..... H01F 27/321
CN 104334797 A 2/2015

(Continued)

OTHER PUBLICATIONS

Chinese Patent Application No. 2021800215942, First Office Action and Search Report dated Jan. 20, 2023, 6 pages.

(Continued)

*Primary Examiner* — Timothy J. Dole
*Assistant Examiner* — Muhammed Azam
(74) *Attorney, Agent, or Firm* — Sage Patent Group

(57) ABSTRACT

A pressboard for high-voltage devices is disclosed. The pressboard has a density of 0.6-1.3 g/cm$^3$ according to IEC60641-2, and includes 1-15% microfibrillated cellulose (MFC) based on the total dry weight of the pressboard. The pressboard also includes an insulation element. For example, the pressboard is impregnated with an electrically insulating compound. The insulation element may be used in a high-voltage device, such as a power transformer.

19 Claims, 1 Drawing Sheet

(56) References Cited

U.S. PATENT DOCUMENTS

| | | | | | |
|---|---|---|---|---|---|
| 4,886,578 | A * | 12/1989 | Hendren | H01B 3/52 | 162/146 |
| 10,702,925 | B1 * | 7/2020 | Everhart | B33Y 80/00 | |
| 2013/0272763 | A1 * | 10/2013 | Moorlag | G03G 15/2057 | 399/333 |
| 2013/0274149 | A1 * | 10/2013 | Lafitte | C09K 8/514 | 507/112 |
| 2014/0083634 | A1 * | 3/2014 | Bjoerkqvist | D21D 1/20 | 162/28 |
| 2014/0131634 | A1 * | 5/2014 | Sunkara | H01B 3/20 | 252/578 |
| 2014/0131635 | A1 * | 5/2014 | Sunkara | H01B 3/20 | 252/579 |
| 2014/0131636 | A1 * | 5/2014 | Sunkara | H01B 3/20 | 252/579 |
| 2014/0131637 | A1 * | 5/2014 | Sunkara | H01B 3/20 | 560/182 |
| 2014/0131638 | A1 * | 5/2014 | Sunkara | H01B 3/20 | 252/579 |
| 2014/0131639 | A1 * | 5/2014 | Sunkara | H01B 3/20 | 252/579 |
| 2014/0131640 | A1 * | 5/2014 | Sunkara | H01B 3/20 | 252/579 |
| 2014/0131641 | A1 * | 5/2014 | Sunkara | H01B 3/20 | 252/579 |
| 2014/0131642 | A1 * | 5/2014 | Sunkara | H01B 3/20 | 252/579 |
| 2014/0135522 | A1 * | 5/2014 | Sunkara | H01B 3/20 | 560/182 |
| 2014/0186576 | A1 * | 7/2014 | Harmer | H01B 3/02 | 428/116 |
| 2017/0186548 | A1 * | 6/2017 | Sato | C04B 35/4682 | |
| 2018/0094383 | A1 * | 4/2018 | Bilodeau | D21C 9/005 | |
| 2018/0148630 | A1 * | 5/2018 | Yakovlev | C09K 8/424 | |

FOREIGN PATENT DOCUMENTS

| | | | | | |
|---|---|---|---|---|---|
| CN | 104334797 | A * | 2/2015 | D21H 11/04 | |
| CN | 104395068 | A | 3/2015 | | |
| CN | 107075806 | A | 8/2017 | | |
| CN | 108447615 | A * | 8/2018 | H01B 12/02 | |
| CN | 113402748 | A * | 9/2021 | | |
| EP | 0387994 | A2 * | 9/1990 | | |
| EP | 0690458 | A2 * | 1/1996 | | |
| EP | 2075801 | A1 * | 7/2009 | H01B 3/20 | |
| EP | 2492922 | A1 * | 8/2012 | H01B 3/306 | |
| EP | 2 867 012 | A1 | 5/2015 | | |
| EP | 3 012 282 | A1 | 4/2016 | | |
| EP | 3012282 | A1 * | 4/2016 | D21H 17/36 | |
| EP | 3882928 | A1 * | 9/2021 | H01B 3/52 | |
| EP | 3544031 | B1 * | 5/2022 | | |
| JP | H087654 | A * | 1/1996 | | |
| JP | H0917612 | A * | 1/1997 | | |
| JP | 2001338853 | A * | 12/2001 | | |
| JP | 2012067298 | A * | 4/2012 | | |
| JP | 2016533918 | A * | 11/2016 | | |
| KR | 19980042478 | A * | 6/1998 | | |
| KR | 20080082835 | A * | 9/2008 | | |
| WO | WO-2008071704 | A1 * | 6/2008 | H01B 3/20 | |
| WO | WO-2008129032 | A1 * | 10/2008 | H01B 3/40 | |
| WO | WO-2011124759 | A1 * | 10/2011 | C09D 7/125 | |
| WO | WO-2012061647 | A2 * | 5/2012 | A23D 9/007 | |
| WO | WO-2013160484 | A1 * | 10/2013 | D21H 11/04 | |
| WO | WO-2014078156 | A1 * | 5/2014 | H01B 3/20 | |
| WO | WO-2015048666 | A1 * | 4/2015 | B82Y 30/00 | |
| WO | WO-2015081487 | A1 * | 6/2015 | B29C 48/0018 | |
| WO | WO-2015142887 | A1 * | 9/2015 | C08K 5/01 | |
| WO | WO-2016097973 | A1 * | 6/2016 | B05D 1/02 | |
| WO | WO-2016172616 | A1 * | 10/2016 | D21C 3/20 | |
| WO | WO-2017024531 | A1 * | 2/2017 | | |

OTHER PUBLICATIONS

International Search Report and Written Opinion of the International Searching Authority, PCT/EP2021/056830, dated Jun. 14, 2021, 15 pages.

Extended European Search Report, dated Aug. 25, 2020 for European Patent Application No. 20163744.4, 8 pages.

Huang Jianwen, et al., "Enhancing mechanical strength and breakdown behavior of insulating presspaper by introduction of nanofibrillated cellulose", 2016 IEEE Internation Conference on High Voltage Engineering and Application (ICHVE), IEEE, Sep. 19, 2016, XP033029944, 4 pages.

Hollertz R, et al., "Novel cellulose nanomaterials", 2014 IEEE 18$^{th}$ International Conference on Dielectric Liquids (ICDL), IEEE, Jun. 29, 2014, XP032637018, 4 pages.

* cited by examiner

MFC IN PRESSBOARDS FOR HV DEVICES

CROSS REFERENCE TO RELATED APPLICATIONS

This application is a 35 U.S.C. § 371 national stage application of PCT International Application No. PCT/EP2021/056830 filed on Mar. 17, 2021, which in turn claims foreign priority to European Patent Application No. 20163744.4, filed on Mar. 17, 2020, the disclosures and content of which are incorporated by reference herein in their entirety.

TECHNICAL FIELD

The present disclosure relates to a pressboard for use as an insulation barrier and/or supporting structure in high-voltage (HV) devices, e.g. power transformers.

BACKGROUND

Modern power transformers normally comprise an oil-immersed core surrounded by winding conductors, which are covered by insulation material.

As electrical insulation, oil-impregnated pressboard is frequently used in power transformers. One of the main functions of the pressboard is to create barriers in the insulation system that prevents electrical flashovers between potential and ground or between different potentials. A limiting property of the pressboard is its electrical withstand emerging from poor matching between pressboard and oil with respect to dielectric constants; large differences result in that the oil is highly stressed under capacitive voltage. It is known that the ratio between dielectric constants of oil and pressboard can be decreased if the density of the pressboard, regularly being about 1.0-1.3 g/cm$^3$, is decreased. One explanation is that a lower density allows the oil to distribute more evenly in the porous structure of the pressboard. However, to merely reduce the density is not an option since a decreased density will also reduce the electrical withstand as well as the mechanical strength of the pressboard. Furthermore, a reduced density will increase the mechanical compressibility that also has negative influence on the design of power transformers. In other words, there is a trade-off between mechanical and electrical properties, and one problem is thus to decrease the electrical stress of the oil without compromising electrical withstand or mechanical strength.

SUMMARY

An objective of the present disclosure is to provide an improved pressboard that may be used as insulation barriers and supporting structures in power transformers.

According to a first aspect of the present disclosure there is provided a pressboard for high-voltage devices, the pressboard having a density of 0.6-1.3 g/cm$^3$ according to IEC60641-2, and comprising 1-15% microfibrillated cellulose (MFC) based on the total dry weight of the pressboard.

By inclusion of MFC in the pressboard and at the same time maintaining or decreasing the density of the pressboard compared with a regular pressboard free of MFC, a pressboard with a low density which has satisfactory mechanical properties is provided that balances electrical withstand with mechanical strength. The electrical withstand includes various voltage shapes, such as direct current (DC), alternating current (AC), lightning impulse (LI) and switching impulse (SI).

According to a second aspect of the present disclosure there is provided an insulation element comprising a pressboard having a density of 0.6-1.3 g/cm$^3$ according to IEC60641-2, wherein the pressboard comprises 1-15% MFC based on the total dry weight of the pressboard, and wherein the pressboard is impregnated with an electrically insulating compound, e.g. a liquid or a resin, such as a cured resin.

According to an aspect of the present disclosure there is provided an insulation element (101) comprising a pressboard (204) for high-voltage devices, the pressboard (204) having a density of 0.6-1.3 g/cm$^3$, comprising 1-15% microfibrillated cellulose, MFC, based on the total dry weight of the pressboard having a thickness of 0.8-10 mm, such as 1.0-9.0 mm, such as 4.0-9.0 mm; and wherein the MFC is homogenously distributed in the pressboard wherein the pressboard is impregnated with an electrically insulating compound (104), e.g. a liquid or a resin, such as a cured resin, wherein a ratio of a permittivity of the pressboard (204) in mineral oil ($\varepsilon_{board,\ mineral}$) and a permittivity of the mineral oil ($\varepsilon_{liq,\ mineral}$) is within a range of:

$\varepsilon_{board,\ mineral}/\varepsilon_{liq,\ mineral}$=1-1.9. In some embodiments, the range is 1-1.6. In some embodiments, the range is 1-1.4 and/or a ratio of a permittivity of the pressboard (204) in ester oil ($\varepsilon_{board,\ ester}$) and a permittivity of the ester oil ($\varepsilon_{liq,\ ester}$) is within a range of:

$\varepsilon_{board,\ ester}/\varepsilon_{liq,\ ester}$=1-1.35. In some embodiments, the range is 1-1.2. In some embodiments, the range is 1-1.1.

Addition of MFC in the pressboard while keeping the density low in comparison with a regular pressboard free of MFC provides for reduced electrical constants of the pressboard, which reduces the difference in electrical constants between the pressboard and the insulating liquid or resin that the pressboard is impregnated with. As a consequence, the electrical stress in the liquid or resin volumes next to the solid insulation element is reduced and impregnated pressboards with tailored dielectric matching are provided.

As a third aspect of the present disclosure, there is provided a use of an insulation element in a high-voltage device, wherein the insulation element comprises a pressboard having a density of 0.6-1.3 g/cm$^3$ according to IEC60641-2, and wherein the pressboard comprises 1-15% MFC based on the total dry weight of the pressboard, and wherein the pressboard is impregnated with an electrically insulating compound, e.g. a liquid or a resin, such as a cured resin.

As a fourth aspect of the present disclosure there is provided a high-voltage device comprising an insulation element, wherein the insulation element comprises a pressboard having a density of 0.6-1.3 g/cm$^3$ according to IEC60641-2, and wherein the pressboard comprises 1-15% MFC based on the total dry weight of the pressboard, and wherein the pressboard is impregnated with an electrically insulating compound, e.g. a liquid or a resin, such as a cured resin. The HV device may be a power transformer, e.g. a liquid-filled power transformer. The HV device may be a liquid-filled HV device, e.g. a liquid-filled power transformer.

What is described above with respect to the second aspect applies to the third and fourth aspects mutatis mutandis.

DETAILED DESCRIPTION

Figure 2:
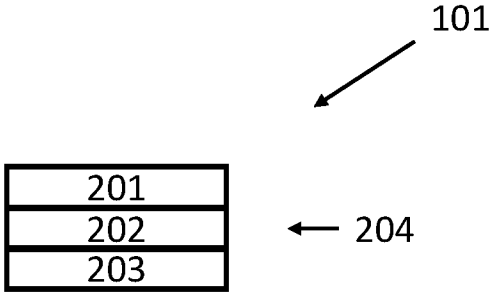
FIG. 2 illustrates an exemplary embodiment of an insulation element (101) according to the present disclosure comprising a pressboard (204) constituting of a first outer layer (201), and inner layer (202) and a second outer layer (203).
Figure 1:
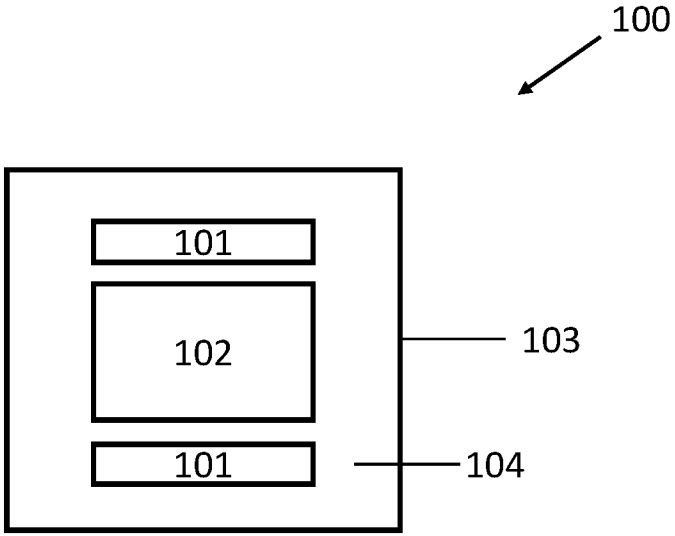
FIG. 1 illustrates an exemplary embodiment of a HV device (100) according to the present disclosure comprising insulation elements (101) comprising MFC, a HV element (102), a housing (103), and an insulating compound (104).

The pressboard (204) for high-voltage devices according to the present disclosure is having a density of 0.6-1.3 g/cm$^3$ according to IEC60641-2, preferably 0.8-1.2 g/cm$^3$, such as 0.8-1.1 g/cm$^3$, such as 0.8-1.0 g/cm$^3$. The pressboard (204) comprises 1-15% MFC. In some embodiments, the pressboard comprises 1-10% MFC. In some embodiments, the pressboard comprises 1-7% MFC. In some embodiments, the pressboard comprises 1-5% MFC. In some embodiments, the pressboard comprises 2-5% MFC. In some embodiments, the pressboard comprises 3-5% MFC based on the total dry weight of the pressboard (204).

Generally, when MFC is added to cellulose-based paper or board, the MFC fills up the voids causing the density to increase. It has now surprisingly been found that providing a low density of the pressboard upon addition of MFC, high mechanical strength as well as electrical withstand are both achieved.

In preferred embodiments of the present disclosure the MFC is homogenously distributed throughout the pressboard (204). Homogeneity is in the context of the present disclosure referring to that the MFC is well-distributed and not concentrated to certain regions of the pressboard. In one embodiment, the pressboard consists of only one pressboard layer, and in an alternative embodiment the pressboard comprises multiple pressboard layers (201, 202, 203), and in such an embodiment, preferably all layers comprise MFC, preferably homogenously distributed.

The thickness of the pressboard (204) according to IEC60641-2 may be 0.8-10 mm, such as 1.0-9.0 mm, such as 4.0-9.0 mm. Pressboard is many times thicker than general purpose insulation paper and presspaper. General insulation paper that is used e.g. as a winded insulation has according to IEC60554-1 a thickness of 15-250 μm, while presspaper has a thickness of 0.075-0.80 mm according to IEC60641-1. The production method of pressboard is also different from the production method of insulating paper. Insulating paper is produced according to standard papermaking methods on a paper machine, whereas pressboard is produced through a process of building up the specified thickness by varying pressing and feeding of furnish in specified cycles.

In the context of the present disclosure, MFC means nano-scale cellulose particle fibres or fibrils with at least one dimension less than 100 nm. MFC comprises partly or totally fibrillated cellulose or lignocellulose fibres. The liberated fibrils have a diameter of less than 100 nm, whereas the actual fibril diameter or particle size distribution and/or aspect ratio (length/width) depends on the source and the manufacturing methods. The smallest fibril is called elementary fibril and may have a diameter of approximately 2-4 nm, while it is common that the aggregated form of the elementary fibrils, also defined as microfibril is the main product that is obtained when making MFC e.g. by using an extended refining process or a pressure-drop disintegration process. Depending on the source and the manufacturing process, the length of the fibrils may vary from around 1 to more than 10 micrometers.

There are different synonyms for MFC which are, sometimes confusingly, used in the literature, such as cellulose microfibrils, fibrillated cellulose, nanofibrillated cellulose (NFC), fibril aggregates, nanoscale cellulose fibrils, cellulose nanofibres, cellulose nanofibrils (CNF), cellulose microfibres (CMF), cellulose fibrils, microfibrillar cellulose, microfibril aggregates and cellulose microfibril aggregates. MFC may also be characterized by various physical or physical-chemical properties such as large surface area or its ability to form a gel-like material at low solids content (1-5 wt. %) when dispersed in water. The cellulose fibre is preferably fibrillated to such an extent that the final specific surface area of the formed MFC is from about 1 to about 200 m$^2$/g, or more preferably 50-200 m$^2$/g when determined for a freeze-dried material with the BET method (Brunauer, Stephen, Paul Hugh Emmett, and Edward Teller. "Adsorption of gases in multimolecular layers." Journal of the American chemical society 60.2 (1938): 309-319.). Nitrogen (N2) gas adsorption isotherms are recorded using an ASAP 2020 (Micromeritics, USA) instrument. Measurements are performed at liquid nitrogen temperatures (i.e., 77 K), and the specific surface areas of the samples were obtained from the isotherms using the BET method.

Various methods exist to make MFC, such as single or multiple pass refining, pre-hydrolysis followed by refining or high shear disintegration or liberation of fibrils. One or several pre-treatment step(s) may be conducted in order to make MFC manufacturing energy efficient including enzymatic or chemical pre-treatment.

The nanofibrillar cellulose may contain some hemicelluloses; the amount may be dependent on factors such as plant source and pulping process. Mechanical fibres may be carried out with suitable equipment such as a refiner, grinder, homogenizer, collider, friction grinder, ultrasound sonicator, fluidizer such as microfluidizer, macrofluidizer or fluidizer-type homogenizer. Depending on the MFC manufacturing method, the product might also contain fines or e.g. other chemicals present in wood fibres or in papermaking process. The product might also contain various amounts of micron size fibre particles that have not been efficiently fibrillated. MFC may be produced from wood cellulose fibres, both from hardwood or softwood fibres. It may alternatively be made from agricultural fibres such as wheat straw pulp, bamboo, bagasse, or other non-wood fibre sources. It is preferably made from pulp of virgin fibre, e.g. mechanical, chemical and/or thermomechanical pulps, preferably never-dried fibres.

The above described definition of MFC includes, but is not limited to, the proposed TAPPI standard W13021 on cellulose nanofibril (CNF) defining a cellulose nanofibre material containing multiple elementary fibrils with both crystalline and amorphous regions, having a high aspect ratio with width of 5-30 nm and aspect ratio usually greater than 50.

There is further provided an insulation element (101) according to the present disclosure comprising the pressboard (204), wherein the pressboard is impregnated with an electrically insulating compound (104), e.g. a liquid or a resin, such as a cured resin.

The inclusion of MFC provides for a low ratio between dielectric constants of electrically insulating liquid and pressboard while at the same time the pressboard has good mechanical properties.

In some embodiments, the insulating element comprises a pressboard which comprises 1-10% MFC. In some embodiments, the pressboard comprises 1-7% MFC. In some embodiments, the pressboard comprises 1-5% MFC. In some embodiments, the pressboard comprises 2-5% MFC. In some embodiments, the pressboard comprises 3-5% MFC. Such value may be based on the total dry weight of the pressboard.

In further embodiments the insulating element comprises a pressboard which has the density 0.8-1.2 g/cm$^3$. In some embodiments, the pressboard density comprises 0.8-1.1 g/cm$^3$. In some embodiments, the pressboard density comprises 0.8-1.0 g/cm$^3$.

In some embodiments the insulating element comprises a pressboard which comprises a plurality of pressboard layers 201, 202, 203.

In some embodiments of the insulating element all layers comprise MFC.

In some embodiments, the electrically insulating compound is or comprises an oil, such as mineral oil, or an ester-based liquid. The mineral oil is derived from crude oil or natural gas, while the ester-based liquid is an ester fluid, preferably an ester fluid derived from plants or crops, such as from rapeseed, canola or soybean.

In further embodiments, the electrically insulating compound (104) is or comprises a cured resin, such as an epoxy-based resin, a polyester-based resins or a phenolic resin, or a combination thereof.

The insulation element (204) may have a direct current (DC) and/or alternating current (AC) and/or lightning impulse (LI) and/or switching impulse (SI) electrical breakdown Weibull α-value that is 5-50%. In some embodiments, the value is 15-50%. In some embodiments, the value is 30-50% higher compared with a corresponding insulation element being free of MFC. The insulation element is having an increased breakdown Weibull α-value for at least some of the voltage shapes DC, AC, LI and SI due to the density of the insulation element. That the corresponding insulation element is free of MFC is in the context of the present disclosure referring to an insulation element without MFC but otherwise identical. The Weibull α-value is a measure of breakdown strength.

The DC and/or AC and/or LI and/or SI electrical breakdown Weibull β-value of the pressboard (204) may be above 7, preferably above 9, more preferably above 12. The Weibull β-value is a measure of the statistical spread of the breakdown strength around the alpha value. A higher beta value implies a low statistical spread. In some embodiments, the permittivity determined according to IEC62631-2-1 of the pressboard in mineral oil ($\varepsilon_{board,\ mineral}$) and permittivity of the mineral oil ($\varepsilon_{liq,\ mineral}$) have a ratio of: $\varepsilon_{board,\ mineral}/\varepsilon_{liq,\ mineral}$=1-1.9. In some embodiments, the ratio comprises 1-1.6. In some embodiments, the ratio comprises 1-1.4.

Alternatively, the permittivity of the pressboard (204) in ester oil ($\varepsilon_{board,\ ester}$) and permittivity of the ester oil ($\varepsilon_{liq,\ ester}$) may have a ratio of $\varepsilon_{board,\ ester}/\varepsilon_{liq,\ ester}$=1-1.35. In some embodiments, the ratio may be 1-1.2. In some embodiments, the ratio may be 1-1.1.

The permittivity-ratio between pressboard and insulating compound may beneficially be close to 1. A permittivity-ratio close to 1, or equal to 1, means that the insulating compound is under low stress under capacitive voltage. The permittivity-ratio is dependent on what type of insulating compound that is used.

There is further provided the use of an insulation element (101) in accordance with an embodiment of the present disclosure in a high-voltage device (100), wherein the pressboard (204) is impregnated with an electrically insulating compound (104), e.g. a liquid or a resin, such as a cured resin.

There is further provided a high-voltage device (100) comprising an insulation element (204) in accordance with an embodiment of the present disclosure, wherein the pressboard (204) is impregnated with an electrically insulating compound (104), e.g. a liquid or a resin, such as a cured resin. The insulating compound is the same as the one that is impregnating the board.

Embodiments of the present invention may be described in any one of the following points.

1. A pressboard (204) for high-voltage devices, the pressboard (204)

having a density of 0.6-1.3 g/cm$^3$, and comprising 1-15% microfibrillated cellulose, MFC, based on the total dry weight of the pressboard.

2. The pressboard (204) according to point 1, comprising 1-10% MFC, such as 1-7% MFC, such as 1-5% MFC, such as 2-5% MFC, such as 3-5% MFC based on the total dry weight of the pressboard.

3. The pressboard (204) according to any one of the preceding points, wherein the density is 0.8-1.2 g/cm$^3$, such as 0.8-1.1 g/cm$^3$, such as 0.8-1.0 g/cm$^3$.

4. The pressboard (204) according to any one of the preceding points, having a thickness of 0.8-10 mm, such as 1.0-9.0 mm, such as 4.0-9.0 mm.

5. The pressboard (204) according to any one of the preceding points, wherein the pressboard comprises a plurality of pressboard layers (201, 202, 203).

6. The pressboard (204) according to point 5, wherein all layers comprise MFC.

7. The pressboard (204) according to any one of the preceding points, wherein the MFC is homogenously distributed in the pressboard.

8. An insulation element (101) comprising a pressboard (204) according to any one of the points 1-7, wherein the pressboard is impregnated with an electrically insulating compound (104), e.g. a liquid or a resin, such as a cured resin.

9. The insulation element (101) according to point 8, wherein the electrically insulating compound (104) is or comprises an oil, such as mineral oil, or an ester-based liquid.

10. The insulation element (101) according to point 8, wherein the electrically insulating compound (104) is or comprises a cured resin, such as an epoxy-based resin, a polyester-based resin or a phenolic resin, or a combination thereof.

11. The insulation element (101) according to any one of points 8-10, wherein the direct current, DC, and/or alternating current, AC, and/or lightning impulse, LI, and/or switching impulse, SI, electrical breakdown Weibull α-value of the pressboard (204) is 5-50%, preferably 15-50%, even more preferably 30-50% higher compared with a corresponding insulation element being free of MFC.

12. The insulation element (101) according to any one of points 8-11, wherein the direct current, DC, and/or alternating current, AC, and/or lightning impulse, LI, and/or switching impulse, SI, electrical breakdown Weibull β-value of the pressboard (204) is above 7, preferably above 9, more preferably above 12.

13. The insulation element (101) according to any one of the points 8-12, wherein a ratio of a permittivity of the pressboard (204) in mineral oil ($\varepsilon_{board,\ mineral}$) and a permittivity of the mineral oil ($\varepsilon_{liq,\ mineral}$) is within a range of:

$\varepsilon_{board,\ mineral}/\varepsilon_{liq,\ mineral}$=1-1.9, preferably 1-1.6, more preferably 1-1.4 and/or a ratio of a permittivity of the pressboard (204) in ester oil ($\varepsilon_{board,\ ester}$) and a permittivity of the ester oil ($\varepsilon_{liq,\ ester}$) is within a range of:

$\varepsilon_{board,\ ester}/\varepsilon_{liq,\ ester}$=1-1.35, preferably 1-1.2, more preferably 1-1.1.

14. Use of an insulation element according to any one of the points 8-13 in a high-voltage device (100).

15. A high-voltage device (100) comprising the insulation element (101) of any points 8-13, wherein the high-voltage device is a power transformer, e.g. a liquid-filled power transformer.

The invention claimed is:

1. An insulation element comprising a pressboard for high-voltage devices, the pressboard having a density of 0.6-1.3 g/cm$^3$, comprising 1-15% microfibrillated cellulose (MFC) based on a total dry weight of the pressboard, and having a thickness of 0.8-10 millimeters (mm), wherein the MFC is homogenously distributed in the pressboard, wherein the pressboard is impregnated with an electrically insulating compound, and wherein a ratio of a permittivity of the pressboard in mineral oil and a permittivity of the mineral oil is within a range of and/or a ratio of a permittivity of the pressboard in ester oil and a permittivity of the ester oil is within a range of 1-1.35.

2. The insulating element according to claim 1, wherein the pressboard comprises 1-10% MFC based on the total dry weight of the pressboard.

3. The insulating element according to claim 1, wherein the pressboard has the density 0.8-1.2 g/cm$^3$.

4. The insulating element according to claim 1, wherein the pressboard comprises a plurality of pressboard layers.

5. The insulating element according to claim 4, wherein all of the plurality of pressboard layers comprise MFC.

6. The insulation element according to claim 1, wherein the electrically insulating compound is or comprises an oil and/or an ester-based liquid.

7. The insulation element according to claim 6, wherein the oil comprises mineral oil.

8. The insulation element according to claim 1, wherein the electrically insulating compound comprises a cured resin, such as an epoxy-based resin, a polyester-based resin or a phenolic resin, or a combination thereof.

9. The insulation element according to claim 1, wherein direct current, DC, and/or alternating current, AC, and/or lightning impulse, LI, and/or switching impulse, SI, electrical breakdown Weibull α-value of the pressboard is 5-50% higher compared with a corresponding insulation element being free of MFC.

10. The insulation element according to claim 9, wherein the electrical breakdown Weibull α-value of the pressboard is 15-50% higher compared with the corresponding insulation element being free of MFC.

11. The insulation element according to claim 10, wherein the electrical breakdown Weibull α-value of the pressboard is 30-50% higher compared with the corresponding insulation element being free of MFC.

12. The insulation element according to claim 1, wherein direct current, DC, and/or alternating current, AC, and/or lightning impulse, LI, and/or switching impulse, SI, electrical breakdown Weibull β-value of the pressboard is above 7.

13. The insulation element according to claim 12, wherein the electrical breakdown Weibull β-value of the pressboard is above 9.

14. The insulation element according to claim 13, wherein the electrical breakdown Weibull β-value of the pressboard is above 12.

15. Use of an insulation element according to claim 1 in a high-voltage device.

16. A high-voltage device comprising the insulation element of claim 1, wherein the high-voltage device comprises a power transformer.

17. The high-voltage device of claim 16, wherein the power transformer comprises a liquid-filled power transformer.

18. The insulation element according to claim 1, wherein the electrically insulating compound comprises a liquid or a resin.

19. The insulation element according to claim 18, wherein the electrically insulating compound comprises a cured resin.

* * * * *